United States Patent [19]

Wiening et al.

[11] Patent Number: 4,791,706

[45] Date of Patent: Dec. 20, 1988

[54] METHOD AND APPARATUS FOR EVENING THE SLIVER PRODUCED BY A CARD

[75] Inventors: Wolfgang Wiening; Ulrich Hoffmann, both of Aachen; Heinrich Rake, Aachen-Laurensberg, all of Fed. Rep. of Germany

[73] Assignee: Trützschler GmbH & Co. KG, Möchengladbach, Fed. Rep. of Germany

[21] Appl. No.: 52,591

[22] Filed: May 21, 1987

[30] Foreign Application Priority Data

May 24, 1986 [DE] Fed. Rep. of Germany ..... 3617528
Feb. 5, 1987 [DE] Fed. Rep. of Germany ..... 3703450

[51] Int. Cl.[4] ..... D01G 23/06; D01G 15/00; D01H 5/42

[52] U.S. Cl. ..... 19/105; 19/106 R; 19/210

[58] Field of Search ..... 19/106 R, 240, 105

[56] References Cited

U.S. PATENT DOCUMENTS

| | | | |
|---|---|---|---|
| 4,438,548 | 3/1984 | Grunder | 19/105 |
| 4,494,204 | 1/1985 | Hösel | 19/105 X |
| 4,530,134 | 7/1985 | Hösel | 19/105 |

FOREIGN PATENT DOCUMENTS

| | | |
|---|---|---|
| 2506061 | 9/1975 | Fed. Rep. of Germany . |
| 2704241 | 1/1980 | Fed. Rep. of Germany . |
| 3218114 | 12/1982 | Fed. Rep. of Germany . |
| 466105 | 1/1969 | Switzerland . |
| 0956146 | 4/1964 | United Kingdom . |
| 2112033 | 7/1983 | United Kingdom . |

OTHER PUBLICATIONS

Article by Herbert Becker, Interkama 80, Bericht über den 8. Internationalen Kongress mit Ausstellung für Mess-und Automatisierungstechnik, Teil 2, VDI-Z 123 (1981) No. 1/2, Jan. (1/11), pp. 15-21.

*Primary Examiner*—Louis K. Rimrodt
*Attorney, Agent, or Firm*—Spencer & Frank

[57] ABSTRACT

A method of evening a sliver produced by a carding machine in which a predetermined output rate and draft are set. The method includes the steps of determining the actual weight of a predetermined sliver length by weighing; determining the difference between the actual sliver weight and a desired sliver weight; as a function of the difference altering the draft corresponding to a predetermined sliver thickness; measuring momentary actual thicknesses of the running sliver at a card output for a determined time period or sliver length and generating mechanical signals representing the momentary actual sliver thicknesses; converting the mechanical signals to first electric signals; combining the first electric signals into a second electric signal constituting an average of the first electric signals and representing the actual sliver thickness of the measured sliver; storing the second electric signal; applying the second electric signal to a computer; applying to the computer a third electric signal representing the actual sliver weight; and determining, with the computer and from a function between the actual sliver weight and the actual sliver thickness, a desired sliver thickness corresponding to a desired sliver weight.

7 Claims, 4 Drawing Sheets

METHOD AND APPARATUS FOR EVENING THE SLIVER PRODUCED BY A CARD

BACKGROUND OF THE INVENTION

This invention relates to a method and apparatus for evening the sliver produced by a card, wherein conventionally a determined output rate and a determined draft is set; the actual sliver weight for a given sliver length is determined by weighing and in case of a deviation from a desired sliver weight, the draft (tension) is varied to correspond to a predetermined desired sliver thickness.

According to a known process, in case of predetermined output rate and draft, the sliver number is determined by monitoring weight measurements while sliver regulation is deactivated. By virtue of a subsequent alteration of the draft the difference between the determined (actual) sliver number and the desired sliver number may be reduced. The thus resulting change in the sliver number is verified by renewed weighing. This process is repeated as often as necessary to achieve a sufficient agreement between the desired sliver number and the measured sliver number. Subsequently, the desired sliver thickness value is determined by potentiometer balancing.

In the sliver manufacture it is an objective to produce a sliver having a determined sliver number which should remain substantially constant. According to the known process at the beginning of the manufacture a determined output rate (m/min) and a determined draft (for example, 80-fold) are set. Subsequently, a determined sliver length is sampled and weighed (first monitoring weighing) from which the actual sliver weight (g/m) and thus the actual sliver number (m/g) is obtained. In case of a deviation from the desired sliver number the draft is changed by altering the feed roller speed whereby the quantity of the fiber material supplied to the carding machine is changed. Thereafter a second monitoring weighing is performed. In case the actual sliver weight then corresponds to the desired sliver weight (that is, the actual sliver number is identical to the desired sliver number), the desired sliver thickness may be determined which is utilized as a desired value for setting a sliver regulating device. Since there is a relationship between the sliver thickness and the sliver number dependent upon the fiber material, the desired sliver thickness corresponding to the desired sliver number may be derived from such relationship. The above-described prior art method is disadvantageously complex.

SUMMARY OF THE INVENTION

It is an object of the invention to provide an improved method and apparatus of the above-outlined type from which the discussed disadvantages are eliminated and with which particularly the desired sliver thickness values may be determined in a simple manner.

This object and others to become apparent as the specification progresses, are accomplished by the invention, according to which, briefly stated, during a predetermined time period the actual sliver thickness is measured at the card output; the measured values are converted into an electric signal and combined into an average value for the actual sliver thickness, stored and applied to a computer. Further, a signal representing the actual sliver weight is applied to the computer which determines—from the relationship between the actual sliver weight and the actual sliver thickness—a desired sliver thickness corresponding to a desired sliver weight.

By virtue of the invention, a desired sliver thickness value may be determined in a simple manner. The method merely requires the determination of the output rate and the inputting of the desired sliver number and the actual sliver number determined from the monitoring weighing.

Preferably, the method according to the invention is used in a card sliver regulating system wherein at the output of the card the actual sliver thickness is measured, the measured value is transformed into an electric signal by a transducer and applied to a regulating device which in case of a deviation from a predetermined desired sliver thickness changes the rpm of the drive motor of a setting member, for example, the feed roller or doffer of the carding machine. In order to achieve an automatic setting of the desired sliver thickness value at the regulating device, the latter sets the rpm of the drive motor to a temporary desired value for the sliver thickness. Thereafter, there is determined a desired sliver thickness corresponding to the desired sliver weight and corrected based on the actual sliver weight and the actual sliver thickness and the desired value setter of the regulating device is set according to the corrected desired sliver thickness.

The given magnitudes are the desired output rate and a desired sliver number which are inputted in a computer. Initially, the draft is arbitrary. Starting from a functional relationship between the sliver number and sliver thickness the apparatus determines the corresponding desired sliver thickness value. By virtue of a comparison of the measured sliver thickness value and the desired value, by means of a regulating device (or manually) at constant output rate the actual sliver thickness value may be adapted to the desired sliver thickness value. A possible setting magnitude is the rpm of the feed roller of the card. The resulting actual sliver number is verified by a monitoring weighing. If the weighing shows a difference between the desired and actual sliver numbers, the actual sliver number is inputted in the computer. This input is used to correct the desired sliver thickness value such that the sliver supplied by the carding machine has tee desired sliver number.

Preferably, the computer determines—from a stored, fiber material-related function between sliver weight and sliver thickness—the temporary desired value for the sliver thickness, corresponding to the desired sliver weight.

The apparatus according to the invention for performing the above-outlined method comprises a measuring member which is arranged at the card output, and which may be a sliver trumpet, for determining the actual sliver thickness. A transducer which receives thickness signals from the trumpet is connected with the drive motor of a roller, such as a feed roller or a doffer with the intermediary of a regulating device having a desired value setter. The apparatus is characterized n that the computer is connected to the measuring member for the actual sliver thickness by means of an integrating device and a memory and to an inputting device for the actual sliver weight. Preferably, the computer is connected with the desired value setter of the regulating device. The integrating device is preferably an R.C. member; and the memory is preferably a buffered memory. According to an advantageous feature of the invention, the inputting device receives signals from a weighing device connected to the inputting device. According to another advantageous feature of the invention, the computer combines the electric signals of the transducer corresponding to the actual sliver thickness and the combined signals are stored. From the actual sliver thickness and the actual sliver weight a desired sliver thickness is determined which serves for setting the desired value of the regulating device.

DESCRIPTION OF THE PREFERRED EMBODIMENTS

Figure 1:
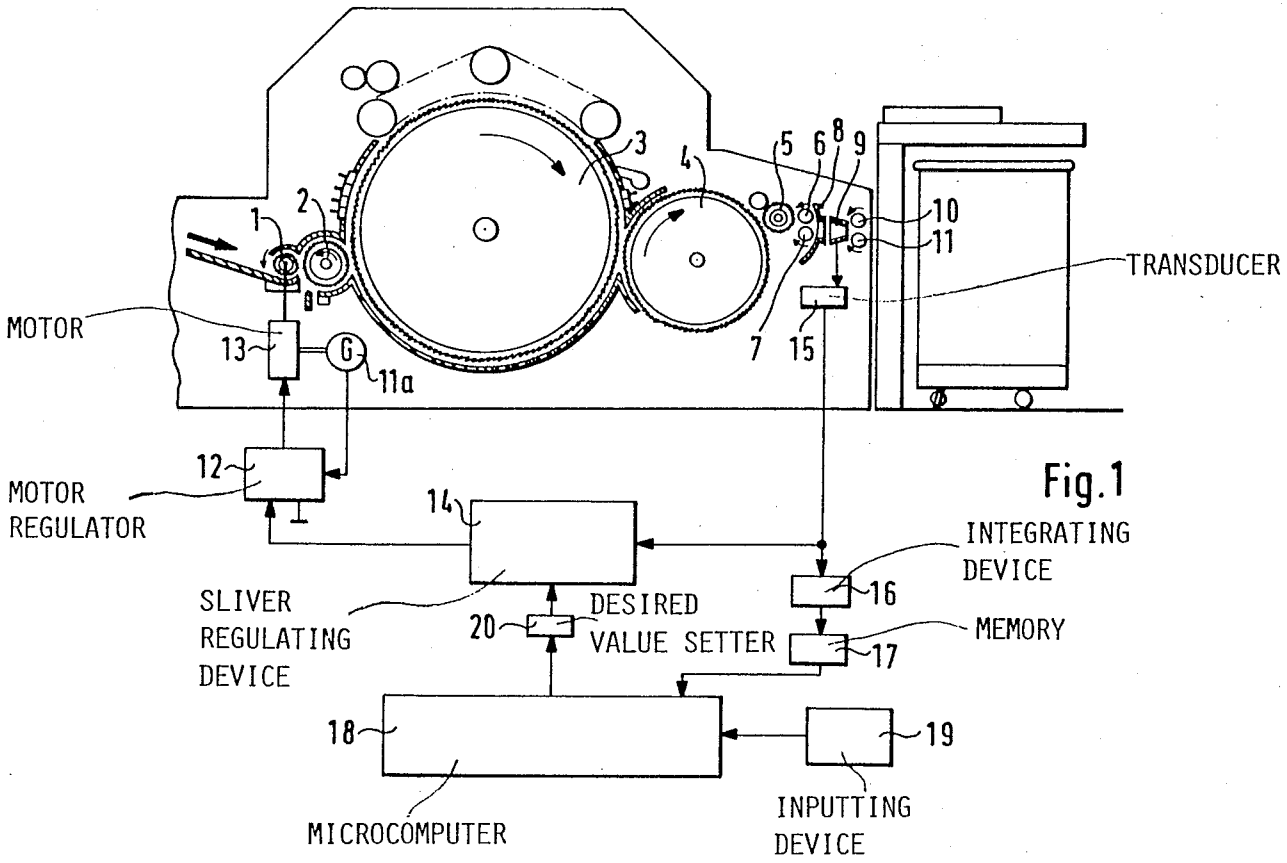
FIG. 1 is a schematic side elevational view, with block diagram, of a preferred embodiment of the invention for regulating the feed roller speed.

Turning to FIG. 1, there is illustrated therein a carding machine which may be an "EXACTACARD DK 3" model, manufactured by Trützschler GmbH & Co. KG, Mönchengladbach, Federal Republic of Germany. The carding machine has a feed roller 1, a licker-in 2, a main carding cylinder 3, a doffer 4, a stripper roller 5, two crushing rollers 6 and 7, a web guiding element 8, a sliver trumpet 9 and two calender rollers 10, 11. The feed roller 1 is coupled with a drive motor which is associated with a motor regulator comprising an electronic tachogenerator 11*a*, an electronic motor regulator 12 (such as a "SIMOREG" model, manufactured by Siemens AG, Federal Republic of Germany) and a variable-speed motor 13 driving the feed roller 1. A desired value setter for the feed roller 1, for example, a potentiometer, is connected with the electronic motor regulator 12. The electronic tachogenerator 11*a* and the electronic motor regulator 12 are connected by means of a sliver regulating device 14 (which may be a "CORRECTACARD CCM" model, manufactured by Trützschler GmbH & Co. KG) with the elements for regulating the sliver gathered by the sliver trumpet 9. A measuring element, for example, the sliver trumpet 9 equipped with a mechanical sensor senses the fluctuations of the sliver thickness. A sliver trumpet with mechanical thickness sensor element is described, for example, in German Offenlegungsschrift (non-examined published application) 2,358,941. The thickness fluctuations of the sliver are converted in a transducer 15 into electric signals applied to the sliver regulating apparatus 14. In this manner the desired rpm of the feed roller 1 is continuously varied as a function of the thickness fluctuation of the sliver. By virtue of a corresponding alteration of the rpm of the feed roller 1, the quantity of fiber material supplied to the card is varied, resulting in a corresponding variation of the weight of the sliver.

The measuring member for the actual sliver thickness, that is, the sliver trumpet 9 is connected with a microcomputer 18 by means of an integrating device 16, such as an R.C. member and a memory 17. The computer 18 is coupled to an inputting device 19 for manual inputting of, for example, the actual sliver weight. Further, the computer 18 is connected with the regulating device 14 by means of a desired value setter 20.

In operation, the desired sliver number is manually inputted in the computer 18 (which is a microcomputer controlling the operation of the carding machine). At a given desired value, in conjunction with a fiber-specific characterizing value there may be determined, by means of the inputted calibrating values or a formula, the clearance width of the measuring trumpet 9 at which the zero balancing for the regulating system 14 is to be effected for the desired sliver number. The zero balancing for determining the desired sliver value is automatically performed under the control of the microcomputer 18. A time-wise limited test phase is started during which the actual sliver thickness is measured, integrated and stored. The sliver produced during the test phase is manually removed and weighed. From the result of the weighing and a length determination the actual sliver number may be established. This sliver number or the length and weight values of the sliver specimen are applied to the computer 18. If the desired sliver number deviates from the measured actual sliver number, the computer 18 calculates the correction for the zero balancing (desired value) and performs thereafter automatically a new zero balancing at the previously calculated point. Thereafter, the regulating device is activated. In this manner, a self-setting carding machine is obtained in which the setting of the desired sliver thickness is carried out in the above-described manner in order to obtain the desired sliver number.

Figure 2:
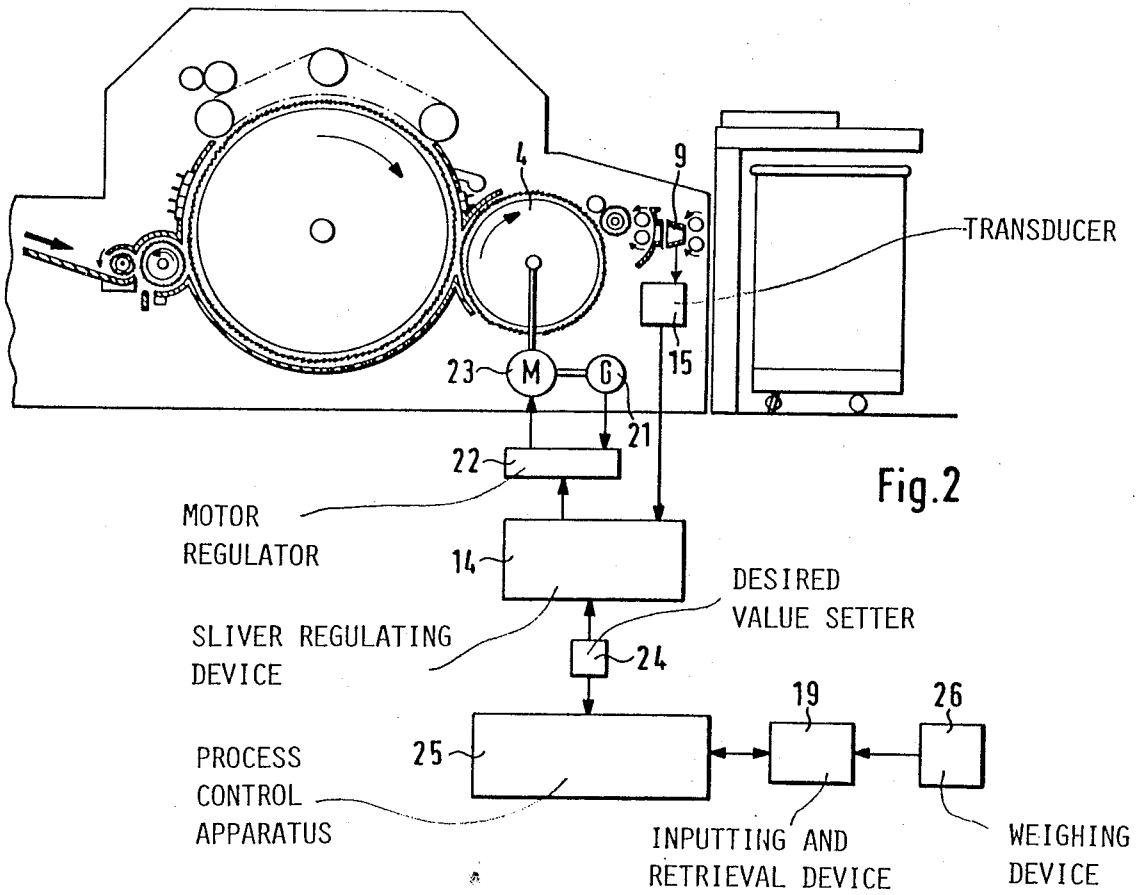
FIG. 2 is a schematic side elevational view, with block diagram, of another preferred embodiment of the invention for regulating the doffer speed.

Turning to FIG. 2, with the doffer 4 a motor regulating system is associated which includes an electronic tachogenerator 21, an electronic motor regulator 22 (such as a "SIMOREG" model manufactured by Siemens AG) and a motor 23 which drives the doffer 4 or components associated therewith (including, for example, a sliver coiler). The electronic motor regulator 22 comprises an rpm regulator with a subordinated current regulator. The load part is formed as a semi-controlled one-phase bridge. A desired value setter (such as a potentiometer) for the output rate which corresponds, for example, to the rpm of the doffer 4, is connected with the electronic motor regulator 22. German Offenlegungsschrift No. 2,944,428 describes the regulation of the feed roller 1 and the doffer 4 by means of an electronic motor regulating device 12 and 22, respectively.

The sliver trumpet 9 (sliver thickness measuring device) is connected by means of a transducer 15 with the card sliver regulating system 14 which in turn is connected with the motor regulator 22. Further, the sliver regulating system 14 is connected by means of a desired value setter 24 with a process control apparatus 25 such as a "TMS" model manufactured by Trützschler GmbH & Co. KG, with a microprocessor which may be a Rockwell model 6502. The process control apparatus 25 includes a microcomputer as well as an integrating device and a memory, which are shown in FIG. 1 at 18, 16 and 17, respectively. With the process control apparatus 25 there is connected an inputting and retrieving device 19. For an automatic operation, the inputting device 19 may be coupled with a weighing device 26 which determines automatically the actual sliver weight for a predetermined sliver length (testing phase) and applied the data to the process control apparatus 25.

Figure 3:
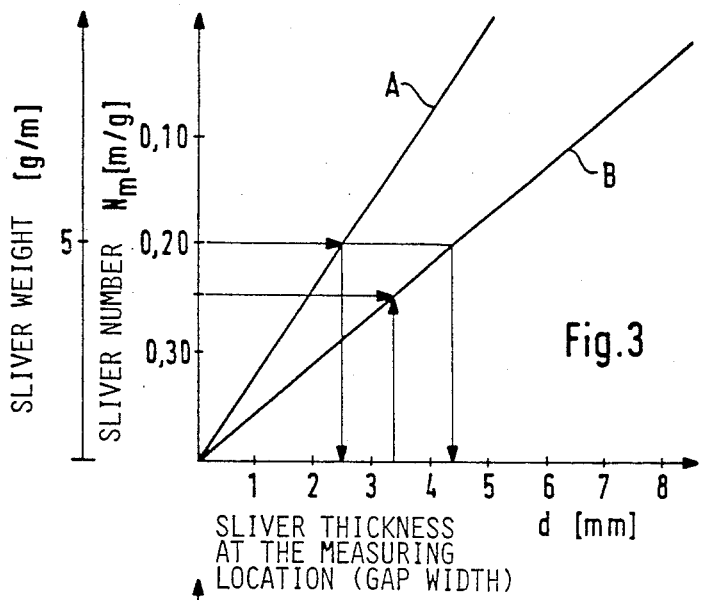
FIG. 3 is a diagram illustrating the sliver weight (or sliver number) as a function of the sliver thickness, determined while the sliver regulating device is idle.

Turning now to FIG. 3, there is graphically illustrated the determination of the desired sliver thickness according to the invention. Such determination is effected in the following steps:

(a) The regulating device 14 is switched off.

(b) At the beginning of the operation there is set with the potentiometer an output rate for the doffer 4, for example 200 m/min and an arbitrary draft, for example, an 80-fold draft at the potentiometer of the feed roller 1, whereby an arbitrary sliver thickness is set. The setting of the output rate and the draft are procedures known by themselves.

(c) The curve A of FIG. 3 is inputted in the memory of the computer 18. The curve A shows the relationship between sliver weight (or sliver number) and sliver thickness at the measuring location of the sliver trumpet 9. The curve A is fiber material-specific and had been determined empirically.

Figure 4:
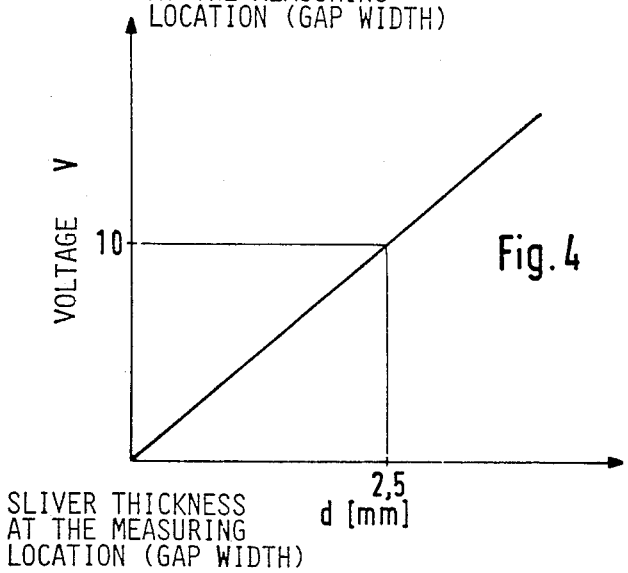
FIG. 4 is a diagram illustrating the voltage of a plunger coil of a measuring element as a function of the sliver thickness, at the measuring location.

(d) The function between the voltage U of a plunger coil which is connected in the CORRECTACARD device with the sensor lever of the measuring trumpet 9 and the sliver thickness (clearance width) at the measuring location in the sliver trumpet 9 according to FIG. 4 is applied to the computer 18. This relationship serves for calibrating (zero balancing) the regulating device 14.

(e) The desired sliver number is applied to the computer 18 via the inputting device 19. Such sliver number may be, for example, $N_m=0.20$ m/g (desired value).

(f) According to curve A to the desired sliver number $N_m=0.20$ m/g there corresponds a provisional desired sliver thickness of d=2.5 mm. This thickness is determined by the computer 18.

(g) First zero balancing of the regulating device. To the provisional desired sliver thickness d=2.5 mm there corresponds according to FIG. 3 a voltage U=10V at the plunger coil of the transducer 15. Based on that voltage there is automatically set the sensor lever and thus the clearance d=2.5 mm in the sliver trumpet 9 by means of the plunger coil. In this manner there is automatically set, by means of the desired value setter 20 of the regulating device 14, the provisional desired sliver thickness d=2.5 mm determined by the computer 18 in the measuring trumpet 9. By virtue of the provisional desired sliver thickness there is first obtained an approximate value for the desired sliver number of 0.20

(h) Weighing check. The actual sliver number is determined by weighing; for example, $N_m=0.16$ m/g (actual sliver number). This result indicates that the sliver is too heavy.

(i) Determination of the actual sliver thickness. For a predetermined sliver length (or a predetermined time period) the electric signals for the actual sliver thickness values are integrated at the measuring location in the sliver trumpet 9 and are thereafter stored and applied to the computer 18. The result is, for example, d=3.5 mm (actual sliver thickness).

(j) Computer. From the actual sliver number $N_m=0.16$ m/g and the actual sliver thickness of d=3.5 mm the computer 18 generates a new curve B.

(k) From the curve B there is obtained for the desired sliver number a value $N_m=0.20$ m/g, a corrected desired sliver thickness $d_{corr}=4.4$ mm.

(1) Second zero balancing. The corrected desired sliver thickness $d_{corr}=4.4$ mm is set in the regulating device 14 by means of the desired value setter 20. In this manner, the corrected desired sliver thickness is automatically set by the computer 18 at the sliver measuring trumpet 9.

(m) Thereafter, the regulating device 14 is switched on. At the desired sliver thickness $d_{corr}=4.4$ mm the discharged sliver has the desired sliver number $N_m=0.20$ m/g.

In the above-discussed method of the invention first the regulating device 14 has been disconnected as the operating person manually assumes the task of the regulating device 14.

The method according to the invention may be also performed while the regulating device 14 remains operational. The steps of the method in such a case are as follows:

(a) The regulating device is switched on.

(b) Initially there is set an output rate of, for example, 200 m/min at the potentiometer of the doffer 4 and an arbitrary draft, for example, an 80-fold draft at the potentiometer of the feed roller 1, whereby an arbitrary sliver thickness is obtained. The setting of the output rate and the draft by means of the potentiometer are procedures known by themselves.

Figure 5:
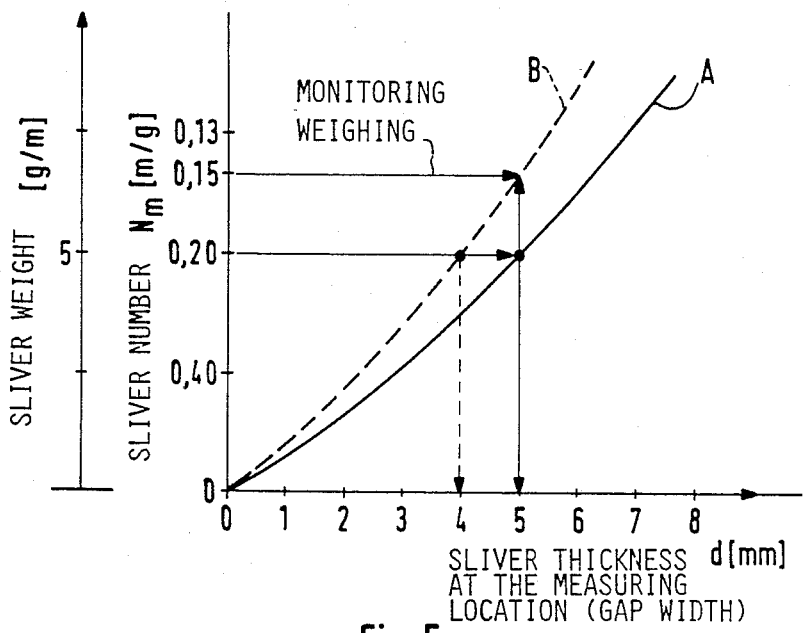
FIG. 5 is a diagram illustrating the sliver weight (or sliver number) as a function of the sliver thickness, determined while the sliver regulating device is operational.

(c) In a memory of the computer 18 the curve A of FIG. 5 is inputted. Curve A represents the relationship between the sliver weight (or sliver number) and the sliver thickness at the measuring location of the sliver trumpet 9. The curve is fiber material-specific and had been previously determined empirically.

(d) The function between the voltage U at the plunger coil which is connected in the CORRECTACARD device with the sensor lever of the measuring trumpet 9 and the sliver thickness (clearance width) at the measuring location in the sliver trumpet 9 is inputted in the computer 18 according to FIG. 4. This relationship serves for calibrating (zero balancing) the regulating device 14.

(e) The desired sliver number is applied to the computer 18 via the inputting device 19. Such sliver number may be, for example, $N_m=0.20$ m/g (desired value).

(f) To the desired sliver number $N_m=0.20$ m/g there corresponds according to curve A provisional desired sliver thickness of d=5 mm. This thickness is determined by the computer 18.

(g) First zero balancing of the regulating device. To the provisional desired sliver thickness d=5 mm there corresponds according to FIG. 5 a voltage U=10V at the plunger coil. Based on that voltage there is set automatically the rpm of the feed roller 1 by means of the regulating device. This automatically sets in the measuring trumpet 9, by means of the desired value setter 20 of the regulating device 14 the provisional desired sliver thickness d=5 mm determined by the computer 18. By virtue of setting the provisional desired sliver thickness there is obtained first an approximate value for the desired sliver number of 0.20.

(h) Weighing check. By weighing, the actual sliver number is determined which was found to be $N_m=0.15$ m/g (actual sliver number). This value indicates that the sliver is too heavy.

(i) Computer. From the actual sliver number $N_m=0115$ m/g and the actual sliver thickness d=5 mm the computer 18 generates a new curve B.

(j) From the curve B there is obtained for the desired sliver number $N_m=0.20$ m/g a corrected desired sliver thickness $d_{corr}=4.0$ mm.

(k) Second zero balancing. The corrected desired sliver thickness $d_{corr}=4.0$ mm is set with the desired value setter 20 of the regulating device 14. In this manner there is automatically set the corrected desired sliver thickness (determined by the computer) in the regulating device 14.

The invention was described by way of an example for determining the actual sliver thickness in a sliver trumpet 9 with a mechanical thickness sensing. The invention may find application for all equivalent measuring values corresponding to the actual sliver thickness, for example, determination of the actual sliver mass, for example, by means of light irradiation, pneumatic measuring processes, weighing processes or scintillation counters.

The present disclosure relates to subject matter contained in Federal Republic of Germany Patent Application Nos. P 36 17 528.5 (filed May 24th, 1986) and P 37 03 450.2 (filed Feb. 5th, 1987) which are incorporated herein by reference.

It will be understood that the above description of the present invention is susceptible to various modifications, changes and adaptations, and the same are intended to be comprehended within the meaning and range of equivalents of the appended claims.

What is claimed is:

1. In a method of evening a sliver produced by a carding machine in which a predetermined output rate and draft are set; including the steps of determining the actual weight of a predetermined sliver length by weighing; determining the difference between the actual sliver weight and a desired sliver weight; as a function of said difference altering the draft corresponding to a predetermined sliver thickness; the improvement comprising the steps of (a) measuring momentary actual thicknesses of the running sliver at a card output for a determined time period or sliver length and generating mechanical signals representing said momentary actual sliver thicknesses;

(b) converting said mechanical signals to first electric signals;

(c) combining said first electric signals into a second electric signal constituting an average of the first electric signals and representing the actual sliver thickness of the measured sliver;

(d) storing said second electric signal;

(e) applying the second electric signal to a computer;

(f) applying to said computer a third electric signal representing the actual sliver weight; and (g) determining, with said computer and from a function between said actual sliver weight and said actual sliver thickness, a desired sliver thickness corresponding to a desired sliver weight.

2. A method as defined in claim 1, further comprising the steps of (h) applying said first signals to a sliver regulating apparatus having a desired value setter;

(i) determining a provisional desired sliver thickness representing a deviation of the actual sliver thickness from a desired sliver thickness;

(j) varying, by said sliver regulating apparatus and based on said provisional desired sliver thickness, the rpm of a motor driving a roller of said carding machine;

(k) changing the desired sliver thickness, based on the actual sliver weight and actual sliver thickness, to a corrected desired sliver thickness; and (l) setting the desired value setter of the sliver regulating apparatus to the corrected desired sliver thickness.

3. A method as defined in claim 2, further comprising the step of applying to a memory of the computer a function, based on types of fiber material, between sliver weight and sliver thickness; and further wherein said step of determining a provisional desired sliver thickness comprises the step of determining, with said computer and from said function, said provisional desired sliver thickness in accordance with the desired sliver weight.

4. In a carding machine having rotary rollers handling the fiber processed by the carding machine; a motor driving one of said rollers; and an output discharging a running sliver; an apparatus operatively connected with said carding machine for controlling said carding machine for evening the running sliver; the apparatus including a sliver thickness measuring means arranged at the card output for sensing the actual thickness of the running sliver and generating mechanical signals representing the actual sliver thickness; a transducer connected to said sliver thickness measuring means for converting the mechanical signals into first electric signals; a sliver regulating device connected to said transducer for receiving the signals from said transducer; said sliver regulating device being connected to said motor for controlling the rpm of said motor; a desired value setting device connected with said sliver regulating device; the improvement comprising an integrating device connected to said transducer for receiving said electric signals therefrom and for combining the signals into a second signal representing an actual sliver thickness; a memory connected with said integrating device for receiving said second signal from said integrating device; a computer connected to said memory for receiving signals from the memory; an inputting device connected to said computer for receiving signals from said inputting device and a sliver weighing device connected to said inputting device for applying signals to said inputting device.

5. A carding machine as defined in claim 4, wherein said computer is connected with said desired value setter of said sliver regulating device for receiving signals from said computer.

6. A carding machine as defined in claim 4, wherein said integrating device comprises an RC-member.

7. A carding machine as defined in claim 4, wherein said memory is a buffered memory.

* * * * *